US007370813B2

(12) United States Patent
Hubmann et al.

(10) Patent No.: US 7,370,813 B2
(45) **Date of Patent: *May 13, 2008**

(54) MULTIPLE FUNCTION DISPENSER

(75) Inventors: Curtis H. Hubmann, Racine, WI (US); Mark T. MacLean-Blevins, Westminster, MD (US); Matthew Young, Cambs (GB)

(73) Assignee: JohnsonDiversey, Inc., Sturtevant, WI (US)

( * ) Notice: Subject to any disclaimer, the term of this patent is extended or adjusted under 35 U.S.C. 154(b) by 250 days.

This patent is subject to a terminal disclaimer.

(21) Appl. No.: 11/206,427

(22) Filed: Aug. 18, 2005

(65) Prior Publication Data

US 2005/0274823 A1 Dec. 15, 2005

(51) Int. Cl.
*A62C 5/02* (2006.01)
*B05B 1/30* (2006.01)
*B05B 7/30* (2006.01)

(52) U.S. Cl. ..... 239/310; 239/581.2; 239/354; 239/398; 239/302; 239/525

(58) Field of Classification Search ..... 239/310, 239/353, 354, 361, 367, 344, 302–304, 407, 239/569, 318, 581.2, 398
See application file for complete search history.

(56) References Cited

U.S. PATENT DOCUMENTS

| | | | | |
|---|---|---|---|---|
| 1,202,425 | A | 10/1916 | Randall | |
| 1,721,726 | A | 7/1929 | Boe | |
| 2,389,134 | A | 11/1945 | Brown | 138/45 |
| 2,454,929 | A | 11/1948 | Kempton | 138/45 |
| 2,719,704 | A | 10/1955 | Anderson et al. | 261/18 |
| 2,781,061 | A | 2/1957 | Frey | 138/46 |
| 2,788,244 | A | 4/1957 | Gilmour | 299/84 |
| 2,991,939 | A | 7/1961 | Packard | 239/114 |
| 3,145,735 | A | 8/1964 | Osrow et al. | 137/604 |
| 3,228,613 | A | 1/1966 | Goldstein | 239/318 |
| 3,282,227 | A | 11/1966 | Nielsen | 103/271 |
| 3,357,598 | A | 12/1967 | Kraft | 222/134 |
| 3,473,481 | A | 10/1969 | Brane | 103/262 |
| 3,764,074 | A | 10/1973 | James | 239/318 |
| 3,776,468 | A | 12/1973 | Davenport | 239/310 |
| 3,847,178 | A | 11/1974 | Keppel | 137/515.7 |
| 3,862,640 | A | 1/1975 | Hechler, IV | 137/1 |
| 3,863,843 | A | 2/1975 | Hechler, IV | 239/318 |
| 3,938,550 | A | 2/1976 | Hechler, IV | 137/559 |
| 3,964,689 | A | 6/1976 | Horvath | 239/318 |
| 4,010,768 | A | 3/1977 | Hechler, IV | 137/218 |

(Continued)

OTHER PUBLICATIONS

One Page from a Johnson Wax Professional Brochure dated 2000 showing the J-Fill Portable Spray Unit.

*Primary Examiner*—Davis D. Hwu
(74) *Attorney, Agent, or Firm*—Gregory S. Bollis; Neil E. Hamilton

(57) ABSTRACT

A dispenser for mixing and dispensing a liquid chemical concentrate from a container with a dilutent. The dispenser includes a two piece slideable eductor assembly, one of which is also rotatable. Both a high and low flow rate can be obtained with simultaneous adjustment of concentration of the chemical concentrate. The dispenser has a high degree of accuracy of the amount of dilution of the chemical concentrate as well as positive positioning of the high and low flow rate. The dispenser also provides for proper selection of concentrate during operation and has a lock-in feature during operation.

15 Claims, 11 Drawing Sheets

U.S. PATENT DOCUMENTS

| | | | | |
|---|---|---|---|---|
| 4,014,363 | A | 3/1977 | Hechler, IV | 137/218 |
| 4,277,030 | A | 7/1981 | Hechler, IV | 239/407 |
| 4,382,552 | A | 5/1983 | Lubsen et al. | 239/317 |
| 4,475,689 | A | 10/1984 | Hauger et al. | 239/318 |
| 4,508,272 | A | 4/1985 | Thompson | 239/318 |
| 4,901,923 | A | 2/1990 | McRoskey et al. | 239/123 |
| 5,007,588 | A | 4/1991 | Chow et al. | 239/318 |
| 5,320,288 | A | 6/1994 | Ketcham, Jr. | 239/316 |
| 5,351,875 | A | 10/1994 | Rhine et al. | 222/132 |
| 5,372,310 | A | 12/1994 | Ketcham | 239/317 |
| 5,529,244 | A | 6/1996 | Horvath et al. | 239/318 |
| 5,544,810 | A | 8/1996 | Horvath, Jr. et al. | 239/10 |
| 5,765,605 | A | 6/1998 | Waymire et al. | 141/100 |
| 5,927,338 | A | 7/1999 | Boticki et al. | 137/888 |
| 5,996,907 | A | 12/1999 | Toetschinger et al. | 239/305 |
| 6,079,595 | A | 6/2000 | Meyer et al. | 222/181.3 |
| 6,158,673 | A | 12/2000 | Toetschinger et al. | 239/305 |
| 6,283,330 | B1 | 9/2001 | Gillespie et al. | 222/145.7 |
| 6,363,977 | B1 | 4/2002 | Smeller et al. | 141/18 |
| 6,655,401 | B2 | 12/2003 | Sand et al. | 137/1 |
| 6,988,675 | B2 * | 1/2006 | Hubmann et al. | 239/310 |
| 2002/0008161 | A1 | 1/2002 | Ketcham et al. | 239/310 |
| 2002/0092925 | A1 | 7/2002 | Hubmann et al. | 239/310 |

* cited by examiner

MULTIPLE FUNCTION DISPENSER

CROSS-REFERENCES TO RELATED APPLICATIONS

Priority is based on Provisional Application 60/261,613, filed Jan. 12, 2001, now U.S. Pat. No. 6,988,675 application Ser. No. 09/956,294 filed Sep. 19, 2001 now U.S. Pat. No. 6,708,901 and application Ser. No. 10/658,496 filed Sep. 9, 2003.

STATEMENT REGARDING FEDERALLY SPONSORED RESEARCH

Not Applicable.

BACKGROUND OF THE INVENTION

The field of the invention is dispensers for chemical concentrates, and particularly the dispensing of chemical concentrates at multiple flow rates and different concentrations.

Dispensers of the type concerned with in this invention are disclosed in U.S. Pat. Nos. 5,320,288 and 5,372,310. While the spraying apparatus disclosed in these patents can control the flow of carrier fluid and chemical product, it cannot do so in a precise and controlled manner.

U.S. Pat. No. 2,719,704 discloses a valve element 31 with eductor passages 41 and 43. These interconnect with inlet openings 58 and 61.

U.S. Pat. Nos. 2,991,939 and 4,901,923 disclose eductor type dispensers having rotatable discs with various sized apertures for controlling the amount of concentrate being drawn into the water flowing through a nozzle.

A dispenser which dispenses chemical concentrate should have the capability of dispensing the concentration at a low rate such as in the instance where a bottle is to be filled and at a high rate where a bucket is to be filled. In the instance of a bucket fill, it is desirable if both a low and high concentration of chemical concentrate can be provided.

The prior art provides either a rotatable eductor with concentrate flow passages, eductor type dispensers having rotatable discs with various sized apertures, or a sliding open-venturi. It does not provide a dispensing apparatus with both sliding and rotating eductors as well as valving so as to afford different concentrations of chemical concentrate at different flow rates.

In application Ser. No. 09/956,294 filed Sep. 19, 2001, a dispenser for dispensing different concentrations of chemical concentrate into a stream of water from a concentrate container at different flow rates is disclosed. The teachings of this application are incorporated by reference. The disclosed dispenser includes a body member having a through bore with an inlet end adapted to be connected to a source of pressurized water at one end and an outlet at the opposite end connected to the inlet housing. A valve member is slideably positioned in the through bore of the body member. An eductor is slideably and rotatably received in the body member. The eductor is in contact with the valve member and in fluid communication with a source of chemical concentrate. A trigger member is connected to the body member and eductor to cause slideable movement of the eductor. The eductor and valve member are constructed and arranged to provide control of both different concentrations of chemical concentrate and different flow rates of water and chemical concentrate.

The present invention provides an improvement of the dispenser disclosed in Ser. No. 09/956,294 by providing an improved functionality of the previously disclosed dispenser by preventing rotation of the concentration selection members during operation of the device. This is important to the quality of the delivered diluted product, namely to the precise ratio of the concentrate to the carrier stream and the resultant mixture concentration. The previously disclosed design allowed the concentrate selection device to be rotated during the "ON" condition. During this rotation of the concentrate selection members, the flow of concentrated product to the mixing chamber is blocked and then reopened at a new position corresponding with a different product flow rate. If this is allowed to occur during the "ON" condition, the carrier stream/water flowing the diluted concentration of the product in the container to which dispensing is occurring will be incorrect and, as is the case with many such concentrated products, will not function as intended.

SUMMARY OF THE INVENTION

To provide the previously referred to anti-rotation when "ON" feature, an interlocking guide feature is provided to the dispenser body component and a corresponding recess to accept the guide feature in the eductor component, such that when the eductor translates, as powered by depressing the dispenser trigger, the guide engages the recess and remains engaged during the travel to either the low flow or the high flow condition. When engaged, the guide feature prevents rotation of the eductor assembly but allows linear translation of the eductor assembly as powered by the user through use of the trigger component and as powered by the internal compression spring for returning the eductor assembly to the "OFF" condition. The guide feature and recess are disengaged in the "OFF" condition and the eductor assembly is free to rotate for selection of dilution concentration by the user.

The present invention provides in one embodiment a dispenser for dispensing different concentrations of chemical concentrate into a stream of water from a concentrate container at different flow rates. The dispenser includes a body member having a through bore with an inlet end adapted to be connected to a source of pressurized water at one end and an outlet at the opposite end. A product and a vent passage communicate with the through bore. An eductor is slideably and rotatably received in the through bore. A guide member is positioned in the through bore and a stop member is located on the eductor. There is at least one passage in the stop member for passing over the guide member. There is also at least one stop surface for engaging the guide member. The guide member, the stop member and the stop surface are constructed and arranged to stop axial movement of the eductor, yet allow axial movement of the eductor, yet allow axial movement when the passage is aligned with the guide member.

In one aspect, the dispenser includes first and second parts, only one of which is rotatable with the first part of the eductor being rotatable and extends from the body member.

In yet another aspect, there is a trigger member connected to the body member and eductor to cause slideable movement of the eductor and further includes a latching mechanism with a living hinge.

In another embodiment, the present invention provides a dispenser for dispensing different concentrations of chemical concentrate into a stream of water from a concentrate container at different flow rates comprising;

a body member having a through bore with an inlet end adapted to be connected to a source of pressurized water at one end and an outlet at the opposite end;

a product passage and a vent passage communicating with the through bore;

an eductor slideably and rotatably received in the through bore;

a guide member positioned in the through bore;

a stop member located on the eductor;

at least two passages in the stop member for passing over the guide member, one of the passages including a stop surface;

at least one stop surface for engaging the guide member, the guide member, the stop member and the stop surface constructed and arranged to stop axial movement of the eductor in one phase, allow a first axial movement when one of the passages is aligned with the guide member in a second phase, and allow a second axial movement when another of the passages with the stop member is aligned with the guide member in a third phase.

In another aspect, the dispenser includes a valve member, the valve member positioned in the through bore of the body member and including first and second valve members operatively associated with the eductor, the valve members constructed and arranged so that when the eductor is in the third phase, the first valve member is moved in a linear slideable manner with respect to the second valve member, a first flow rate is effected and when the eductor is in a second phase, the second valve member is moved in a linear slideable manner with respect to the body portion with the first valve member moved linearly with respect to the second valve member, a second increased flow rate is established.

A general object of the invention is to provide a dispensing apparatus which can effect a mixing of chemical concentrate into a stream of water at different concentrations and dispense the mixed concentrate at controlled flow rates.

Another object is a closed dispenser which produces low foam, low air entrapment and a low energy liquid fill independent of the pressure of the attached water supply.

Other general objectives are a dispensing apparatus which can both spray and/or fill, gives control over both flow and dilution and lends itself to be integrated with a bottle so they cannot be separated.

Still another object is a dispenser which is composed of plastic parts, thus economical to produce and is disposable or recyclable.

Yet another object is a dispenser of the foregoing type which provides proper selection of concentrate during operation.

Still yet another object is a dispenser of the foregoing type which can accurately dispense chemical concentrate.

Yet another object is a dispenser of the foregoing type which has a lock-in feature during operation.

DESCRIPTION OF THE PREFERRED EMBODIMENTS

Figure 1:
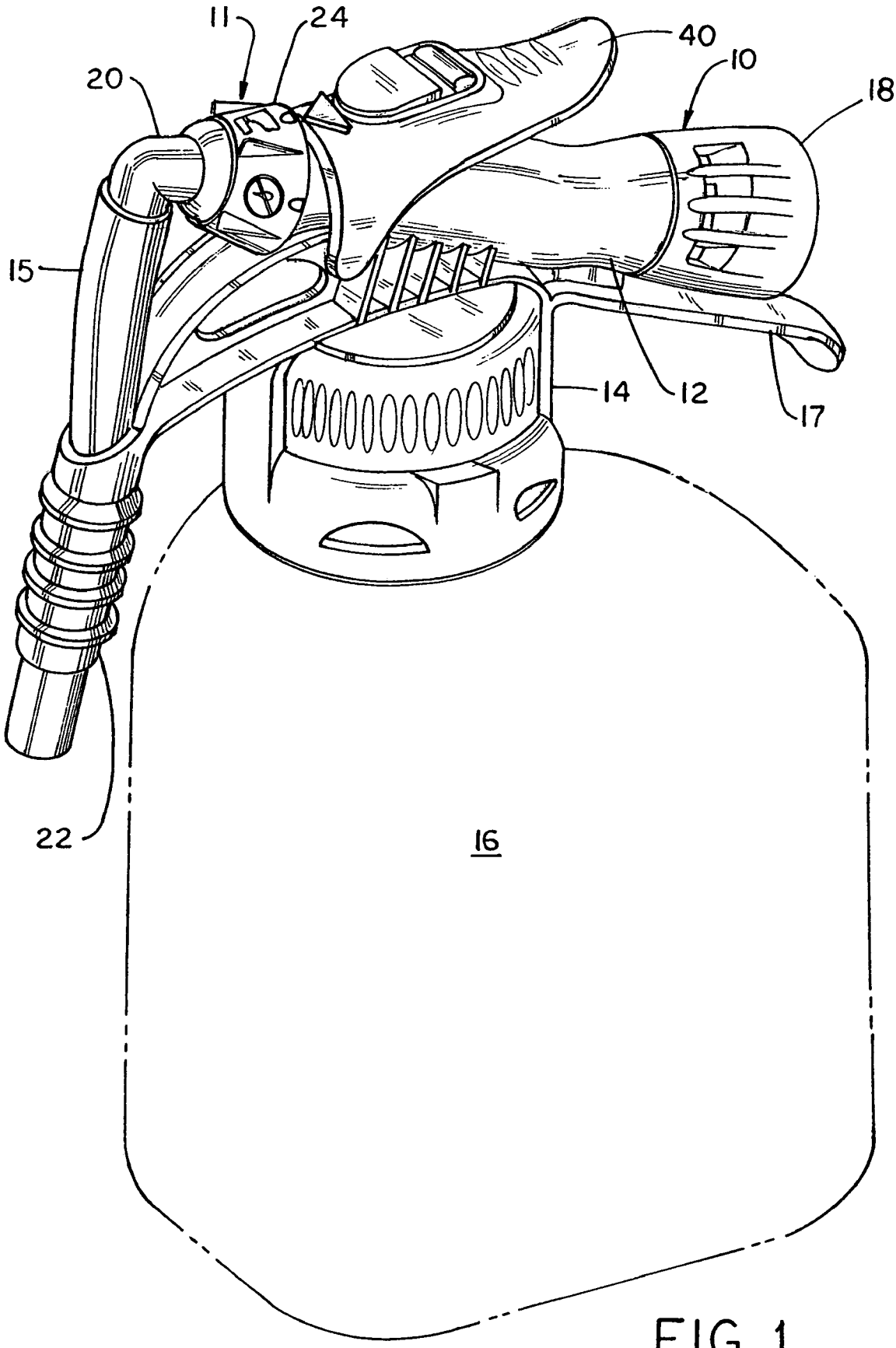
FIG. 1 is a perspective view of the dispenser of this invention in conjunction with a container.
Figure 2:
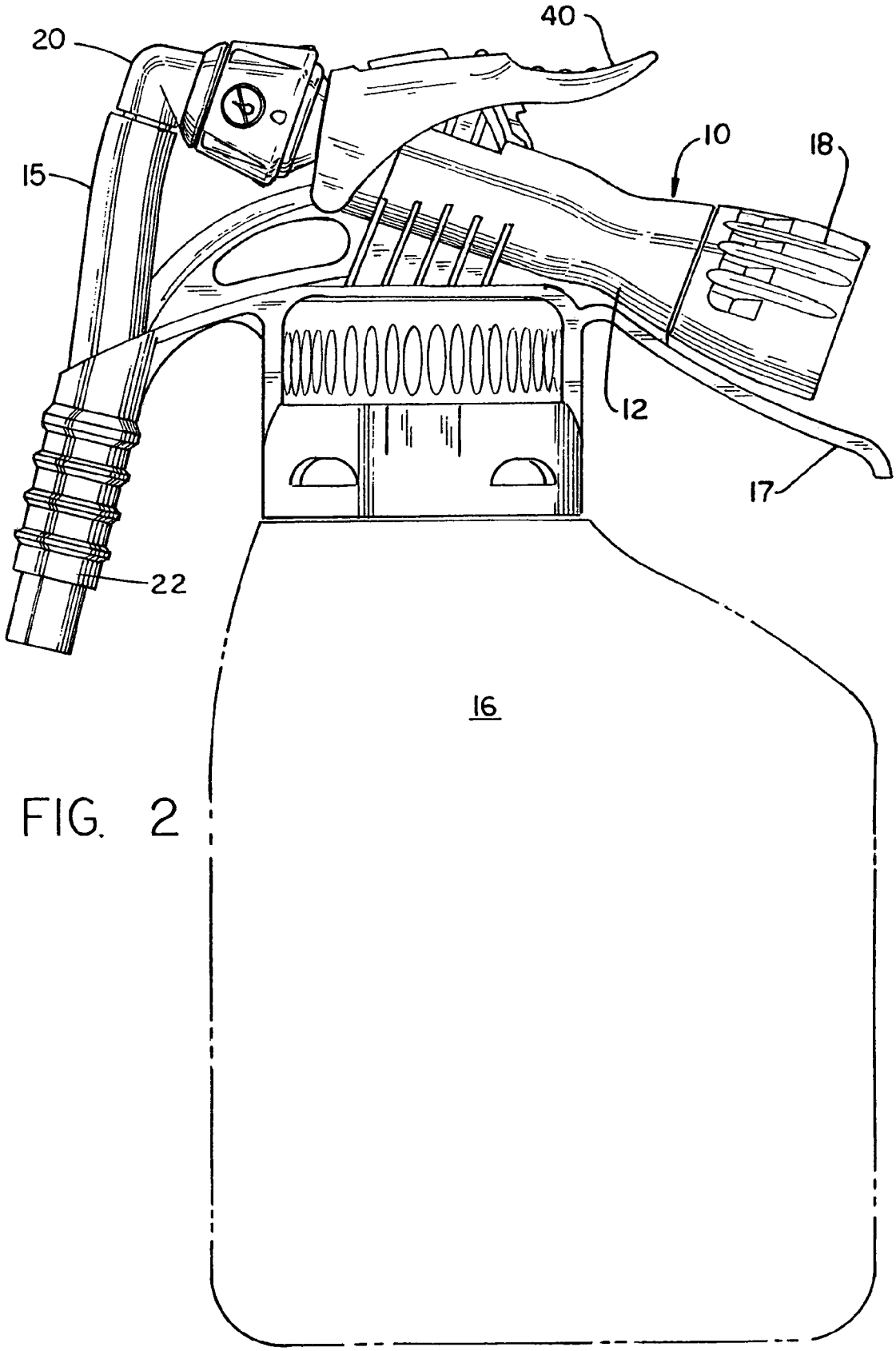
FIG. 2 is a view in side elevation of the dispenser shown in FIG. 1.

Referring to FIGS. 1 and 2, the dispenser generally 10 has a body member 12 with a container connector 14 for connection to a container or bottle 16. A preferred connector system is more fully described in commonly owned patent application Ser. No. 10/037,569 filed Nov. 9, 2001 which teachings are incorporated herein. At one end of the body member 12 is a hose attachment 18 for supplying pressurized water to the dispenser. A handle 17 is provided below attachment 18. At the other end there is the spout 22 and a nozzle 20 for dispensing a mixed chemical solution. A flexible tube 15 extends between nozzle 20 and spout 22.

Figure 3:
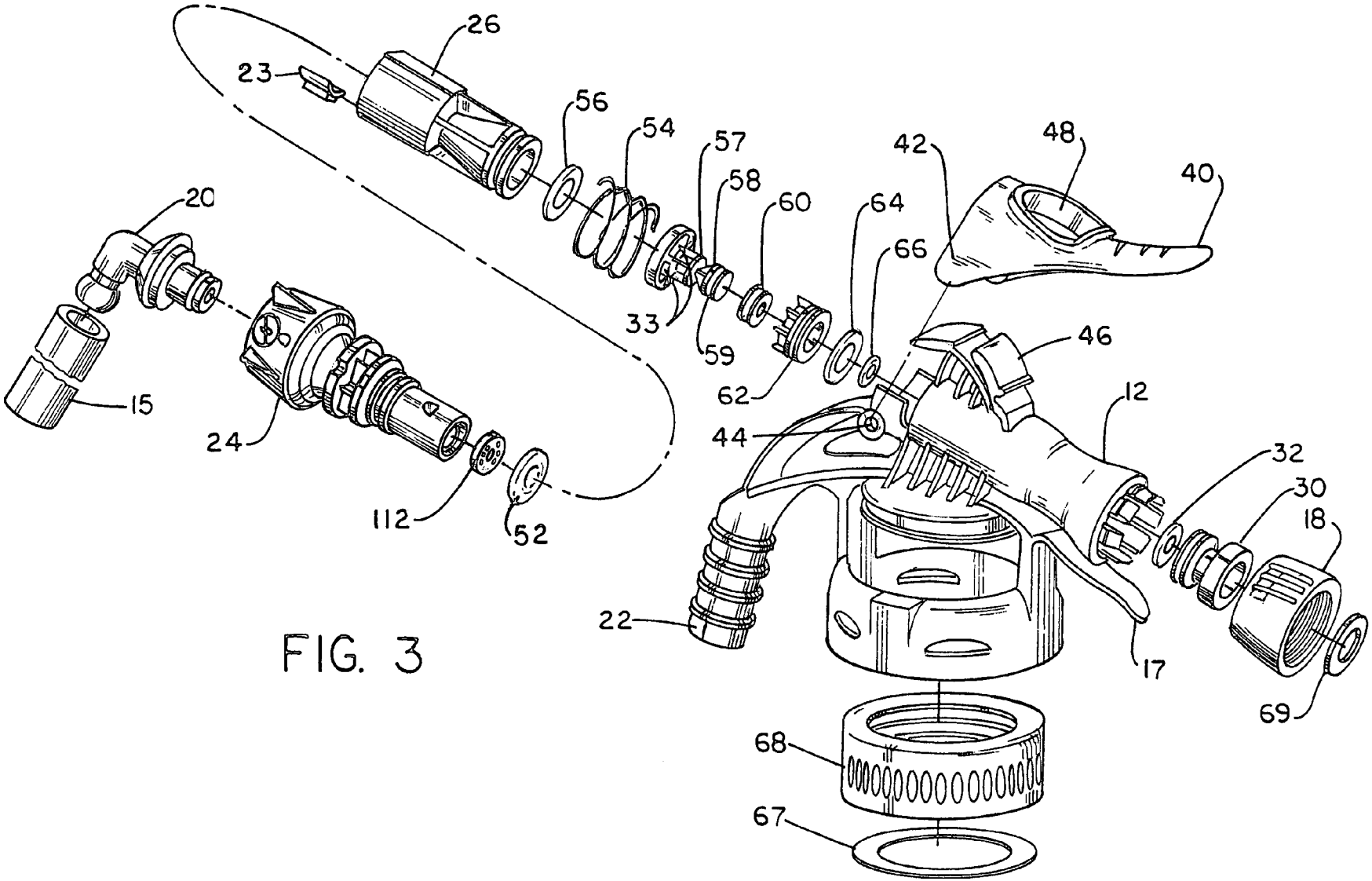
FIG. 3 is an exploded view of the component parts of the dispenser.
Figure 4:
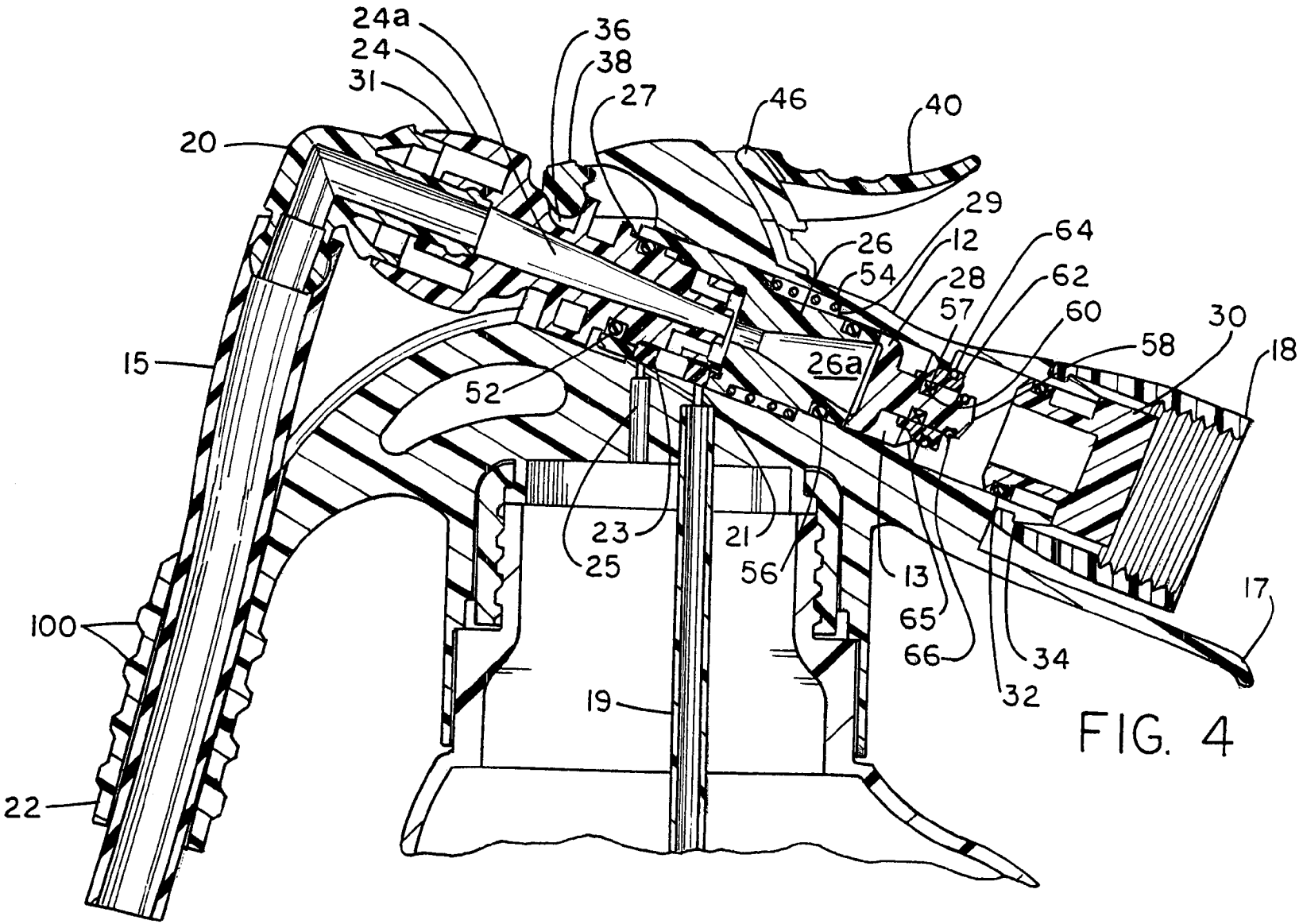
FIG. 4 is a cross sectional view of the dispenser in a closed position.

Referring to FIGS. 1, 3 and 4, the dispenser 10 includes an eductor generally 11 composed of the first or outer eductor part 24 with a diverging passage **24*a* and an inner second eductor part 26 with a converging passage 26*a*. They are slideably connected in body member 12 with O-ring seals 52 and 56 providing a fluid tight contact. A valve assembly 28 for controlling the flow of water through the dispenser 10 is also slideably housed in body member 12 and is in contact with eductor part 26 when the dispenser is in an operating condition. When it is not in an operating condition, the valve assembly 28 is spaced from eductor part 26 to allow for seals 64 and 66 to seal under a range of pressures. The hose attachment 18 is rotatably connected to body member 12 by the snap fitment 34. A back flow preventer 30 is positioned in hose attachment 18 and has an O-ring seal 32 for contact with body member 12. At the opposite end of body member 12, the nozzle 20 is attached to eductor part 24**.

An annular groove 36 is provided in the eductor part 24 and accommodates a head portion 38 of the trigger 40 with flange portions such as shown at 42 on the trigger 40 having shafts (not shown) for extending into bores such as 44. A latch member 46 extends upwardly from the member 12 for fitment through the passage 48 of the trigger 40.

Figure 7:
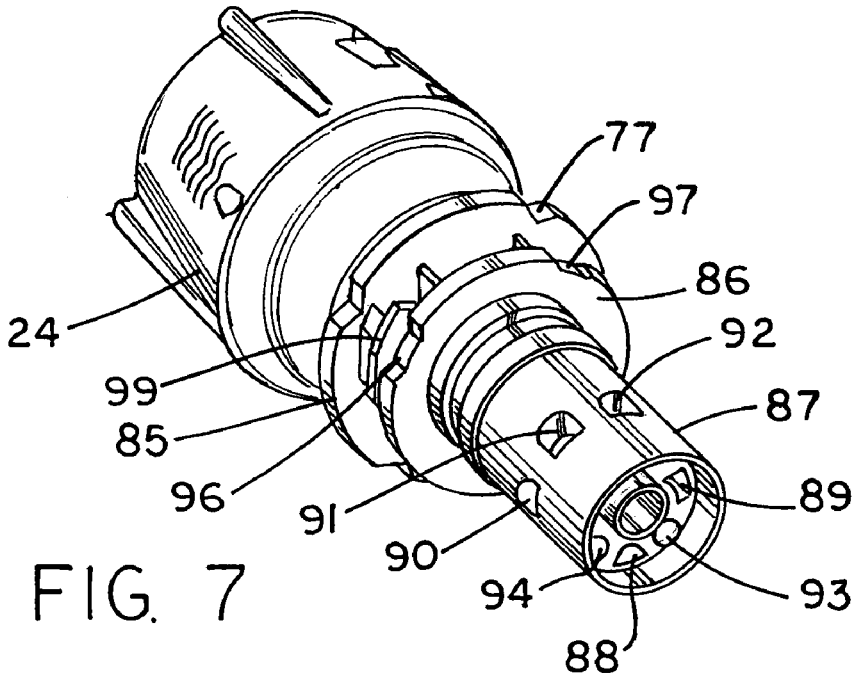
FIG. 7 is a perspective view illustrating the eductor for the dispenser.
Figure 8:
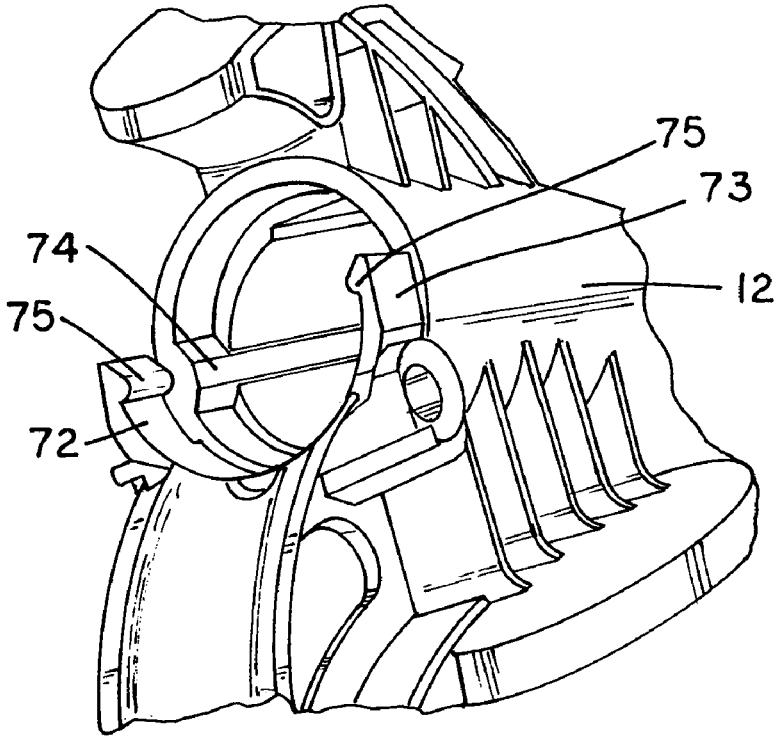
FIG. 8 is a fragmentary view of the dispenser housing illustrating eductor contact and guide surfaces.

As shown in FIG. 7, eductor part 24 has L-shaped passages 90-94 for introducing chemical concentrate into the gap 27 between eductor parts 24 and 26. These passages 90-94 have different diameters or widths for metering different concentrations of chemical concentrate. Accordingly, eductor part 24 with passages 90-94 serves as a dilution adjustment member. In some instances there are no passages, thereby blocking and precluding the flow of concentrate, and used to provide a rinse only function. This is indicated at 89 which is a blank passage. A dip tube 19 is connected to body member 12 and extends into container 16 for siphoning chemical concentrate into the bore 13 of body member 12 by way of passage 21. A seal member 23 is placed between eductor part 26 and body member 12. A vent passage 25 connects container 16 and bore 13. Eductor part 24 is positioned with passages 90-94 inside eductor part 26. A spring 54 biases eductor part 26 as well as eductor part 24 toward the head portion 38 of trigger 40.

Figure 13:
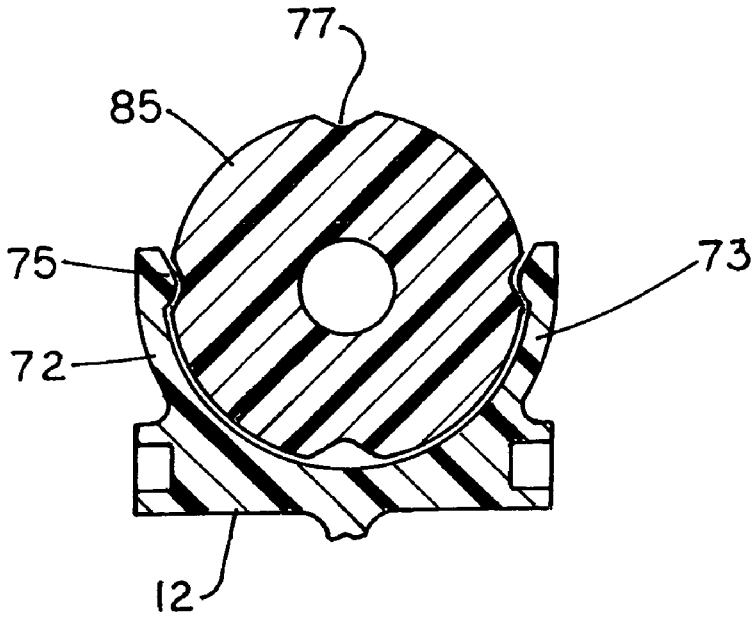
FIG. 13 is a cross sectional view illustrating an indexing of the eductor in the dispenser.

Referring also to FIG. 7, there is shown the eductor 24 with an indexing ring 85 and notches 77. These accommodate the projections 75 on arms 72 and 73 extending from body member 12 as shown in FIG. 13. This provides an indexing function in conjunction with the orientation of dilution adjustment feature of eductor 24 and passage 21.

As seen in FIGS. 3 and 4, a quad O-ring 60 is attached in groove 57 of valve head portion 58. It serves as a flow control element as later explained. A valve member 28 with passages 33 has a head portion 58 with groove 59. An O-ring seal 66 is seated in groove 59 of head portion 58 and another O-ring seal 64 is placed on collar 62. A gasket 67 is provided for cap 68 and a hose seal is provided at 69.

Figure 14:
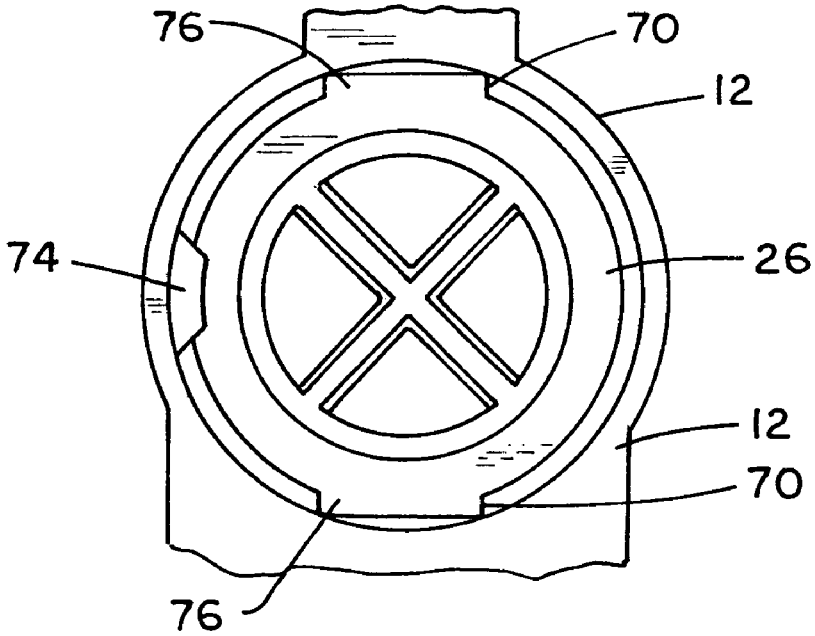
FIG. 14 is an end view of the body member shown in FIG. 8 with an eductor part in place in a keyway.

Referring to FIG. 14, it is seen that body member 12 has a keyway 70 disposed in body member 12 for accommodating key members 76 in eductor part 26 for allowing sliding but nonrotatable connection in body member 12.

As seen in FIGS. 7, 8 and 9-12, there is a selector ring 86 extending from eductor part 24. It has notches 95-98 which pass over guide member 74 to orientate the passages 90-94 with the passage 21 in the body member 12. There are also the core portions 88 which are sealed portions that assist in the molding process.

Referring back to FIG. 3, there is shown a dilution adjustment device 112. This device is fully described in commonly assigned application Ser. No. 09/956,294 filed Sep. 19, 2001. This dilution adjustment device 112 or adapter fits into the end portion 87 of eductor 24 with the tubular members fitting into passages 90-94.

OPERATION

A better understanding of the dispenser will be had by a description of its operation. Referring to FIG. 4, the dispenser is shown in a closed position. A source of pressurized water such as a hose will have been connected to hose attachment 18. In this instance, seal 66 on valve head 58 is seated against collar 62 and seal 64 against valve seat portion 65. Accordingly, no water can pass between these two components and into bore 13. This sealing effect is assisted by the flow of water in through the attachment 18, against the valve components 58 and 62. The spring 54 and force of water also positions the head 31 of eductor part 24 away from body contact surface 79 when in an operating condition.

Figure 5:
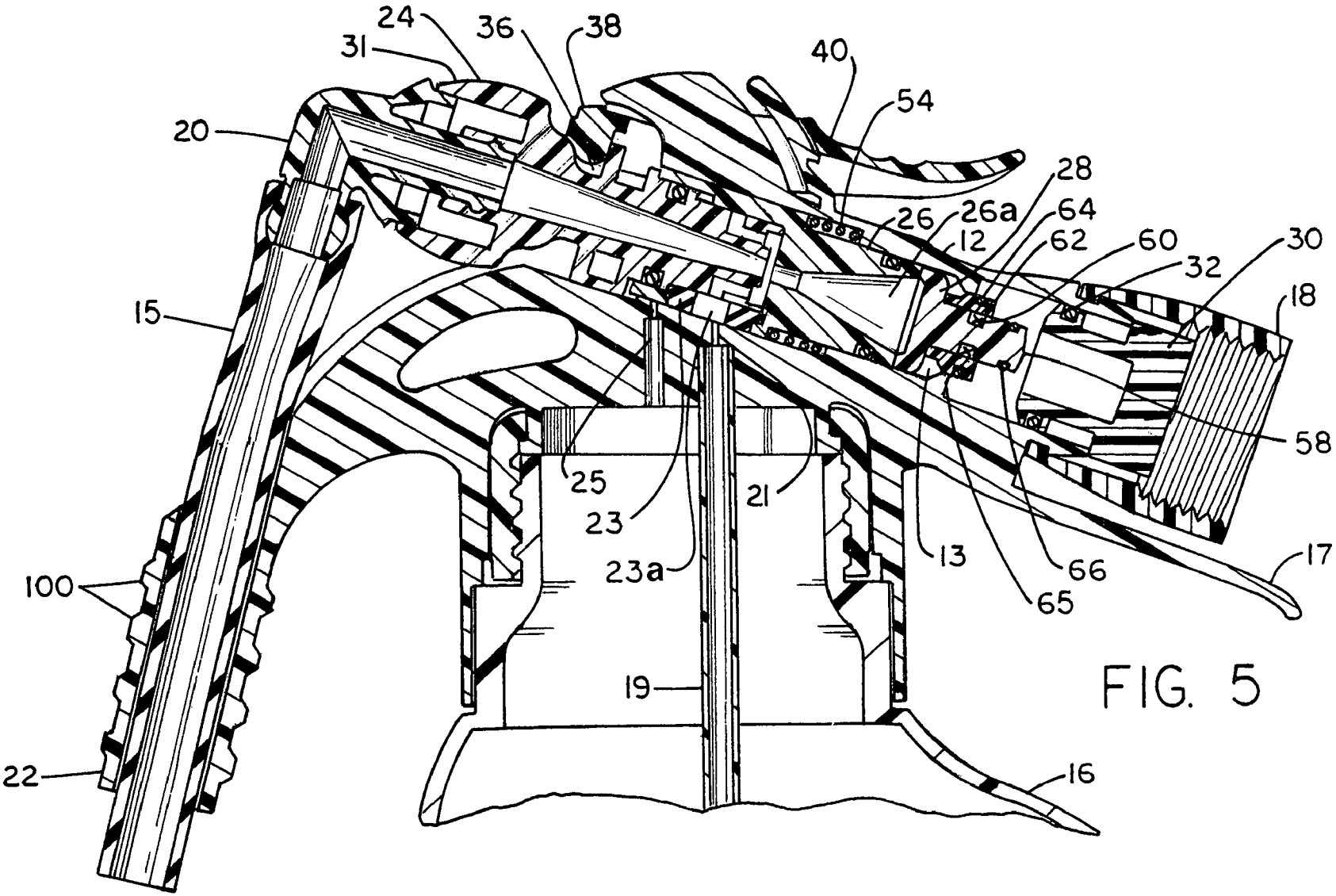
FIG. 5 is a view similar to FIG. 4 showing the dispenser in a low flow condition.

Referring now to FIG. 5, trigger 40 has been moved toward body member 12 with the result that valve portion 58 has moved toward the base attachment 18 and seal 66 no longer engages collar 62. In this position, water can flow between the two component parts as there are grooves (not shown) placed in the collar 62 to allow such flow into bore 13. This is a low flow condition. In this position, the quad O-ring 60 serves as a flow control element, in that, with increased pressure and flow of water, the ring will expand and partially fill the grooves in collar 62. This maintains a consistent flow rate despite variations in the pressure of the inlet water supply. Water can then pass through passages 33 and into passage 26*a* of eductor part 26.

Figure 12:
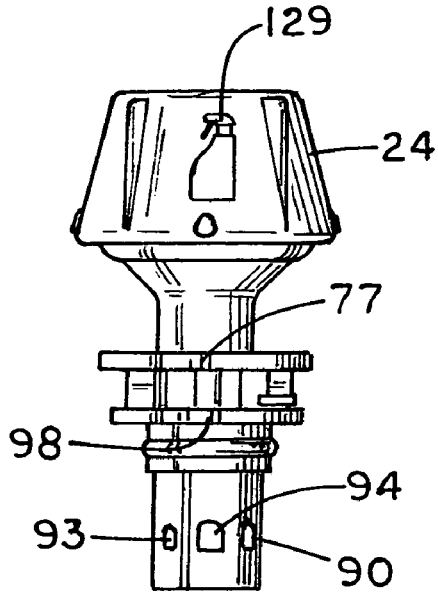

This low flow condition is utilized to fill a bottle which is shown by the icon 129 in FIG. 12. In order to locate eductor parts 24 and 26 in this position, there is a notch 95 in selector ring 86 which is orientated with guide member 74 to allow the eductor parts 24 and 26 to move inwardly into body member 12 until the guide member 74 engages intermediate stop 99 located between selector ring 86 and indexing ring 85. Simultaneously, passage 92 is orientated with passage 21 and dip tube 19 to allow concentrate from container 16 to flow into the water stream in passage 24*a*. It should be pointed out that the orientation between notch 96 when engaged by guide member 74 and icon 129 in body member 12 is 90° whereas the orientation between icon 129 and passage 21 is 180°. It should be further stated that trigger 40 and latch 46 cannot engage at this low flow condition. This is consistent with the high flow condition referred to in the following paragraph.

Figure 6:
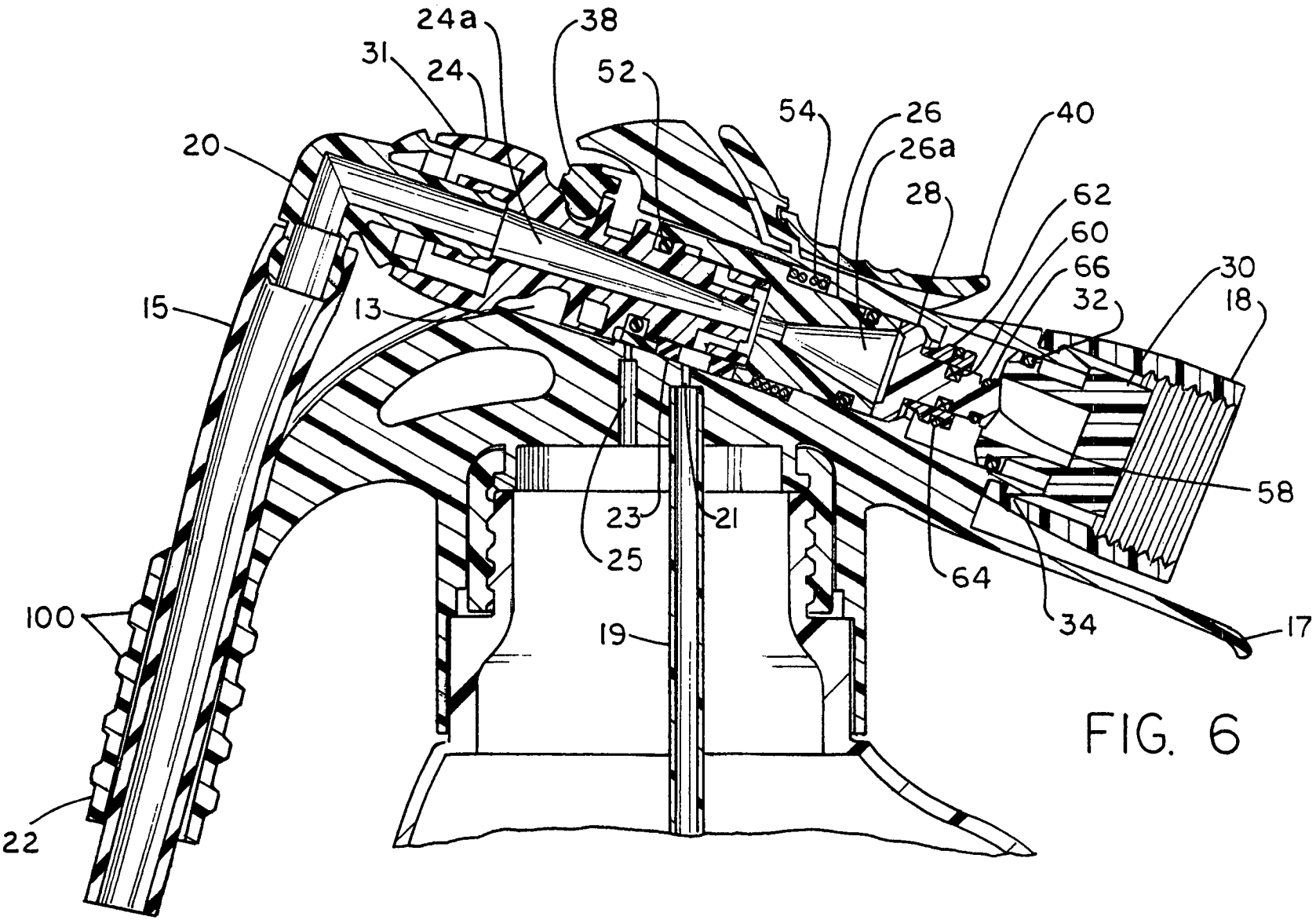
FIG. 6 is a view similar to FIG. 4 showing the dispenser in a high flow condition.

In order to initiate a high flow condition, the trigger 40 is moved further toward body member 12. This is shown in FIG. 6. In this position, not only has seal 66 moved away from collar 62 but collar 62 also has moved away from valve seat portion 65. In this position, water cannot only flow from between head portion 58 and the grooves 63 in the collar 62, but also between the collar 62 and the valve seat portion 65. It should be pointed out that in this high flow position, trigger 40 can now become engaged with latch 46 which provides a living hinge if desired so that it can be held in the high flow condition.

Figure 10:
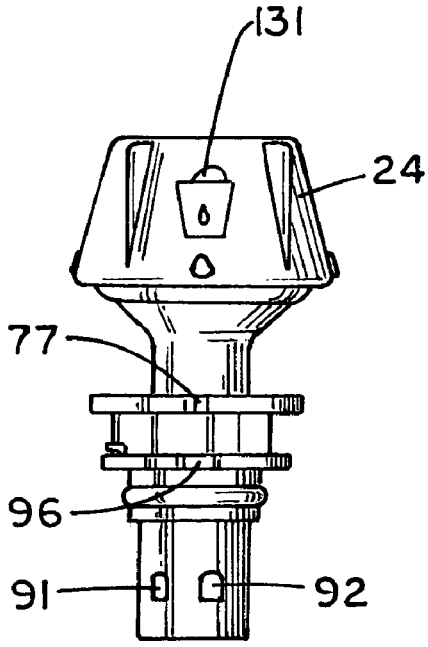

This high flow condition is utilized to fill a bucket which is shown by the icon 131 in FIG. 10. In order to locate eductor parts 24 and 26 in this position, there is a notch 97 in the selector ring 86 which is orientated with guide member 74 to allow the eductor parts 24 and 26 to move inwardly into body member 12 until the guide 74 engages indexing ring 85 which provides a stop surface. Simultaneously, passage 94 is orientated with passage 21 and dip tube 19 to allow concentrate from container 16 to flow into the water stream in passage 24*a*.

Figure 11:
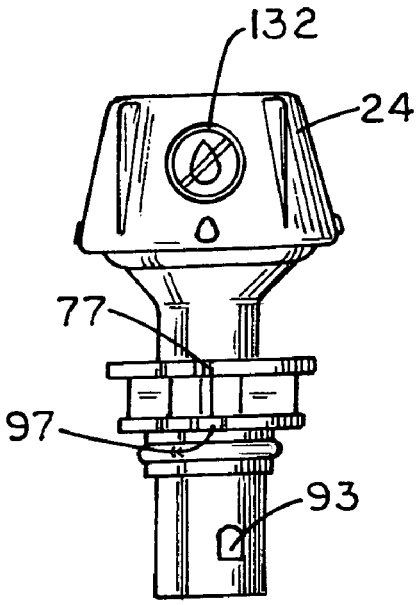
FIGS. 9-12 are elevational views of a portion of the eductor utilized in the dispenser.
Figure 9:
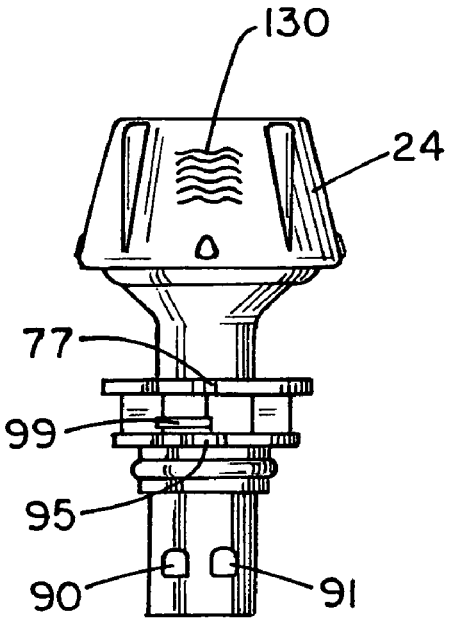

During the previously described flow conditions through the dispenser 10 such as when in the high or low flow condition, and as previously stated, the concentrate will be drawn upwardly from the container 16 such as through the dip tube 19 and passage 21. However, as noted previously in FIG. 4, there is a seal member 23 positioned over the passage 21 so that no product can be drawn up from the container 16. At the same time, seal 23 also closes vent passage 25. As seen in both FIGS. 5 and 6, the seal member 23 has moved away from both the product and vent passages 21 and 25, respectively. In this position, drawn product is allowed to enter into one of the five passages 90, 91, 92, 93 and 94 as seen in FIGS. 9-11. Concentrate is thereby siphoned into gap 27 and mixed with water flowing through passage 26*a* and 24*a*. A reduced pressure is caused by the water converging in passage 26*a* and diverging in passage 24*a*.

The orientation of the various passages 90-94 with the opening 23*a* in seal 23 is facilitated by the indexing shown in FIG. 13.

Figure 16:
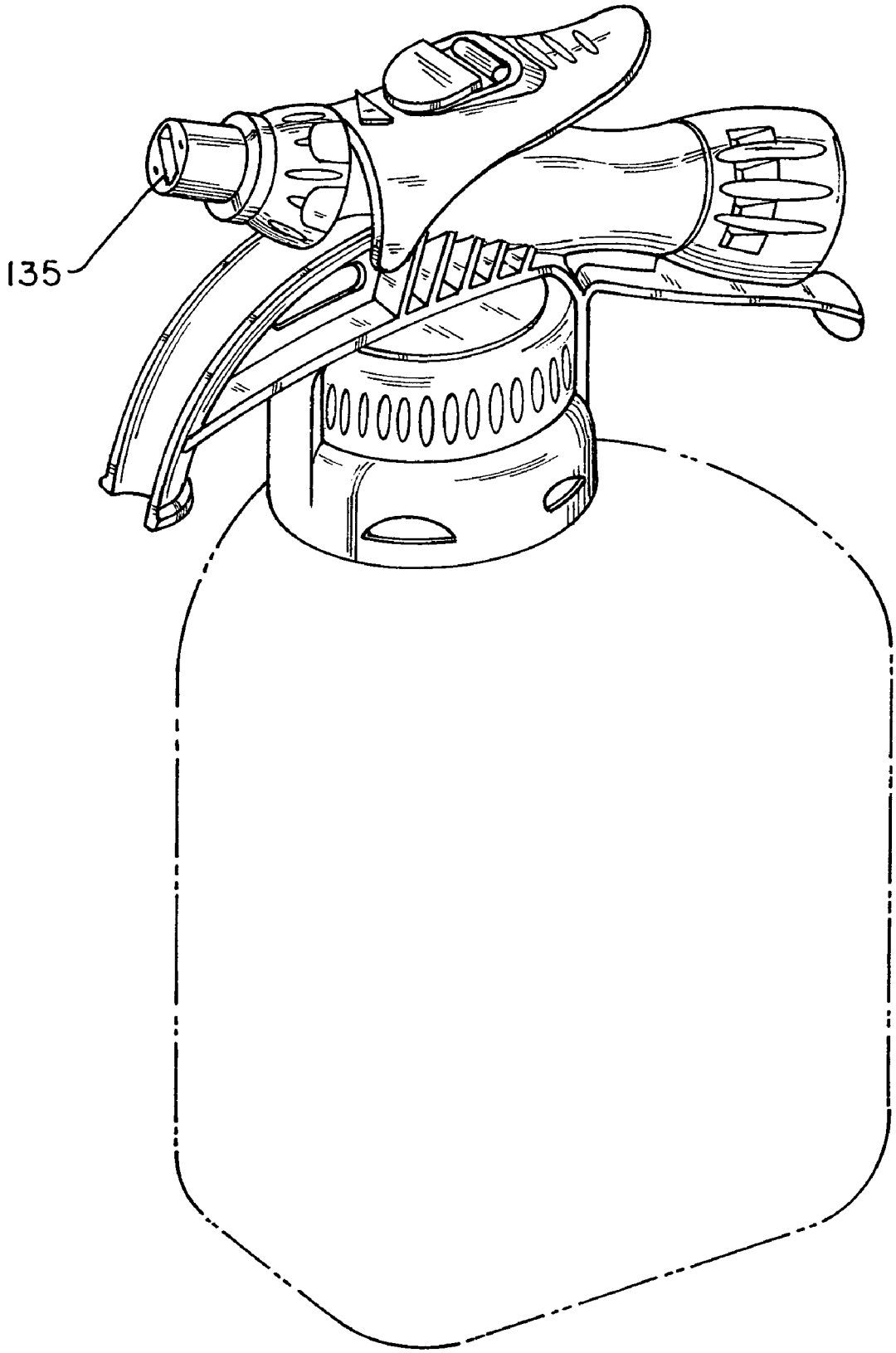
FIG. 16 is a perspective view similar to FIG. 1 illustrating the dispenser with a spray head.

The mixed solution will then exit through nozzle 20 down through the tube 15 positioned in the spout 22. Tube 15 in this instance is flexible so as to allow the eductor 24 to move inwardly and outwardly from the body member 12. With product passing through tube 15 and spout 22, this is the position which is utilized when filling a bucket or a bottle. As previously described a low flow condition would be utilized for filling a bottle while the high flow condition would be utilized to fill a large vessel such as a bucket. The spout 22 provides for the dispenser to be hung on a bucket. If desired, a hose (not shown) can be connected to spout 22 for filling purposes such as a "scrubber washer" or when the dispenser is mounted to a wall. Dispenser 10 can easily be converted to a spray unit by the replacement of the nozzle 20 and the attachment of a conventional spray head. This is shown in FIG. 16. Also stated previously, the concentration of the solution can be easily adjusted by the rotation of the eductor 24 in conjunction with the dilution adjustment passages 90-94. The low and high flow condition in combination with the dilution adjustment member obviates the use of multiple dispenser heads.

In FIG. 9 there is shown an icon 130 which indicates a rinse function. This is affected by water passing through the passage 24*a* without the siphoning of any chemical concentrate. In this position notch 96 is orientated with guide member 74 to allow the eductor parts 24 and 26 to move inwardly into body member 12 until guide 74 engages indexing ring 85 to afford a high flow condition. There will not be any passage orientated with dip tube 19 so that no concentrate is siphoned with the water into passage 24*a*.

In FIG. 11, the icon 132 indicates a no flow condition. This is effected by not providing a notch in selector ring 86 so that ring 86 contacts guide member 74 and consequently eductor parts 24 and 26 cannot be moved inwardly into body member 12, consequently neither vent passage 25 nor concentrate passage 21 can be opened. This acts to assure that the contents of the container cannot be dispensed while the eductor 24 is turned to this position, regardless of the presence of pressurized water.

Figure 15:
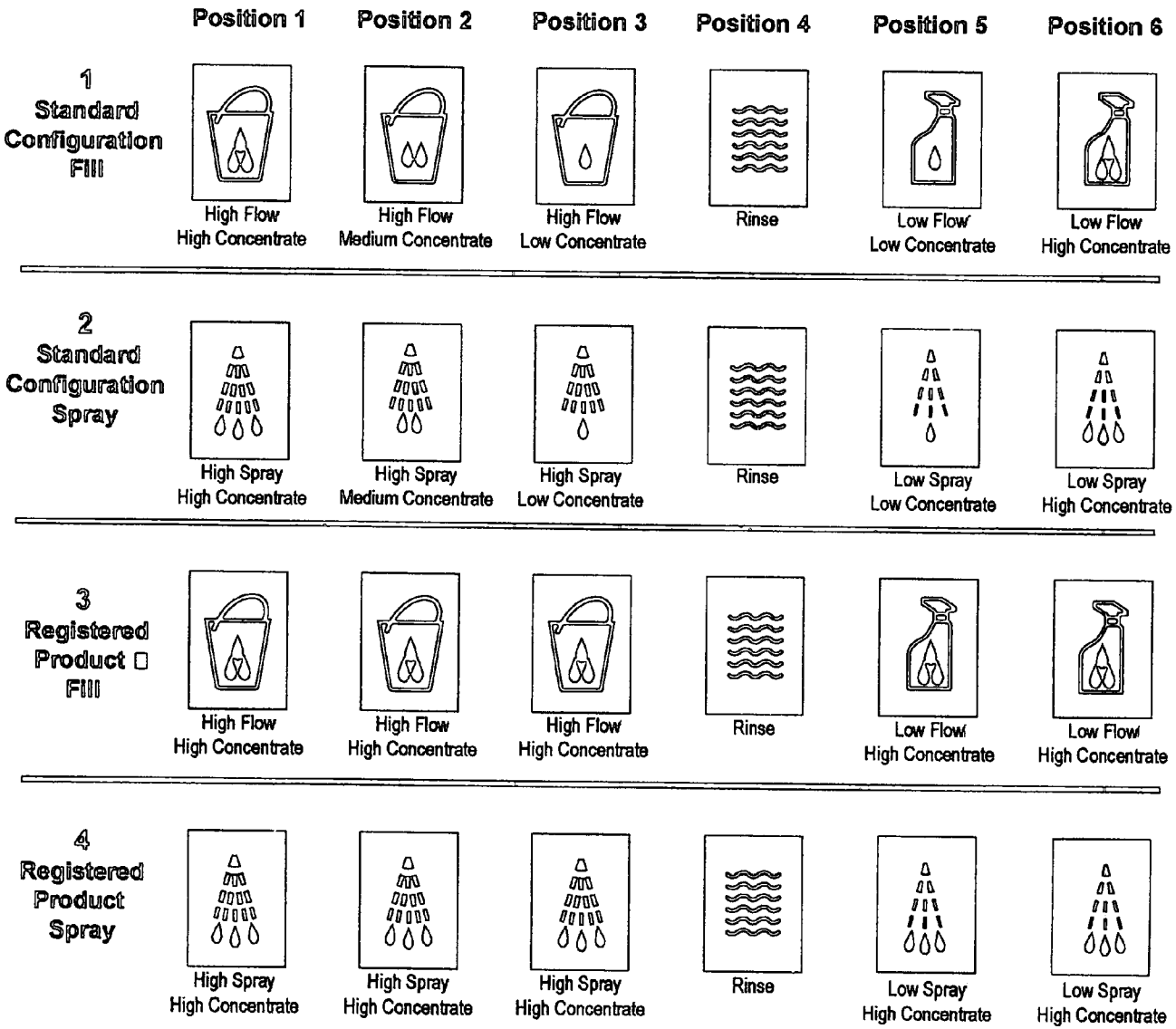
FIG. 15 is a diagrammatic legend illustrating the various functions of the dispenser.

As seen in FIGS. 7, and 9-10, there are 5 passages 90-94 which can convey concentrate through eductor part 24. In the instance where only a single dilution rate for high and low flow is desired, only two passages are required as indicated for the previously described bucket and bottle fill. In the instance where more functions are desired such as illustrated in FIG. 15 at the Standard Configuration Fill line 1, there would be utilized 5 passages: one for high flow, high concentrate; one for high flow, medium concentrate; one for high flow, low concentrate; one for low flow, low concentrate and one for low flow, high concentrate. The high, medium and low concentrate is regulated by the size of the passages 90-94.

As illustrated in the Standard Configuration Spray line 2, and as stated previously, the dispenser can be equipped with a spray head as shown at 135 in FIG. 16. It could then perform all of the functions as previously described for the Standard Configuration Fill in line 1. Registered Product Fill and Spray lines 3 and 4 illustrate the use of the dispenser 10 wherein the previously described high and low functions would be employed yet all of the passages 90-94 would be designed to perform a high concentrate function.

While a six position function for the dispenser 10 is indicated in the illustration of FIG. 15, one of these positions could be a stop no flow condition as previously stated in conjunction with FIG. 11.

It will thus be seen that there is now provided a very versatile dispenser which can be utilized in not only a high and a low flow condition but also can be adjusted to vary the concentration of mixed solution. The dispenser 10 is produced economically so that once it is captively connected to a container, it is disposable and/or recyclable. As indicated in the drawings, most of the components are composed of a molded plastic with polypropylene being preferred. This affords a living hinge feature for latch member 46 in trigger passage 48.

It will also be seen that a good hand feel is provided by dispenser 10. This is accomplished by placement of the handle 17 beneath body member 12 and outwardly from trigger 40 to allow placement of a thumb on trigger 40.

An important feature of dispenser 10 is the orientation of the guide member 74 in the notches 95-98. This prevents rotation of eductor part 24 during a flow condition and affords delivery of accurate concentrations of chemical product. It should be further stated that selector ring 86 affords a stop surface for contact with guide member 74 when guide member is not orientated with notches 95-98. This prevents eductor 11 from moving inwardly into body member. Indexing ring 85 provides a second stop surface when notches 95-98 move over guide member and guide member contacts indexing ring 85 when the eductor is moved into body member 12.

The dispenser 10 has been preferably described in conjunction with a latching feature for the trigger 40. It is obvious that this is not an essential feature that can be eliminated. Neither is it essential that a back flow preventer be employed in the unit itself. This could be accomplished upstream in a supply line. Further, while the spout 22 offers the advantage of a hose attachment such as with the barbs 100, this could be eliminated although it does further offer the advantage of a bucket attachment. Neither is it essential that the container connector 14 provides a captive use of the dispenser with the container. The dispenser 10 could be utilized with a refillable container. In some instances, it may be desirable to limit the dispenser for flow through a single passageway. This could be accomplished by placement of a pin through body member 12 and a groove in eductor part 24 or may be accomplished by an additional part called the lock out clip. This clip, when installed, makes it difficult to turn the selector portion of the lower eductor. All such and other modifications within the spirit of the invention are meant to be within a scope as defined by the appended claims.

What is claimed is:

1. A dispenser for dispensing different concentrations of chemical concentrate into a stream of water from a concentrate container at different flow rates comprising;

a body member having a through bore with an inlet end adapted to be connected to a source of pressurized water at one end and an outlet at the opposite end;

a product passage and a vent passage communicating with the through bore;

an eductor slideably and rotatably received in the through bore;

a guide member positioned in the through bore;

a stop member located on the eductor;

three passages in the stop member for passing over the guide member; and a stop surface for engaging the guide member, the guide member, the stop member and the stop surface constructed and arranged to stop axial movement of the eductor, yet allow axial movement when one of the passages is aligned with the guide member.

2. The dispenser of claim 1 wherein the eductor is composed of first and second parts, only one of which is rotatable.

3. The dispenser of claim 2 wherein the first part of the eductor is rotatable and extends from the body member.

4. The dispenser of claim 3 wherein the second part of the eductor is nonrotatable and the first and second parts of the eductor provide a fluid passage with the product passage.

5. The dispenser of claim 4 further including a dilution adjustment member connected to the rotatable eductor for fluid communication with the fluid passage.

6. The dispenser of claim 5 further including a product passage and a vent passage in the body member and a seal constructed and arranged to seal both the product passage and the vent passage.

7. The dispenser of claim 5 wherein the dilution adjustment member includes a multiplicity of different sized passages.

8. The dispenser of claim 1 further including an elongated spout connected to the body member, the spout adapted to be hung on a bucket.

9. The dispenser of claim 8 further including a flexible tube member connected to the eductor and the spout.

10. The dispenser of claim 1 further including a spray nozzle connected to the eductor.

11. The dispenser of claim 1 wherein a trigger member is connected to the body member and eductor to cause slideable movement of the eductor and further includes a latching mechanism.

12. The dispenser of claim 11 wherein the latching mechanism further includes a living hinge.

13. The dispenser of claim 1 wherein the stop member is provided by a selector ring.

14. The dispenser of claim 13 further including an indexing member, the indexing member providing a stop surface.

15. The dispenser of claim 13 wherein an intermediate stop is connected to the selector ring.

* * * * *

UNITED STATES PATENT AND TRADEMARK OFFICE

CERTIFICATE OF CORRECTION

PATENT NO. : 7,370,813 B2
APPLICATION NO. : 11/206427
DATED : May 13, 2008
INVENTOR(S) : Curtis H. Hubmann, Mark T. MacLean-Blevins and Matthew Young It is certified that error appears in the above-identified patent and that said Letters Patent is hereby corrected as shown below:

The priority information in the first paragraph of the specification does not appear on the face of the patent:

On the Title Page of the patent: Item [60] --Related U.S. Application Data--
should read
--Continuation of application No. 10/658,496, filed on Sept. 9, 2003--
--Continuation-in-part of application No. 09/956,294, filed on Sept. 19, 2001, U.S. Patent No. 6,708,901--
--Provisional application No. 60/261,613, filed on Jan. 12, 2001--

Signed and Sealed this

Tenth Day of March, 2009

John Doll

JOHN DOLL
*Acting Director of the United States Patent and Trademark Office*